US005522284A

United States Patent [19]

Säde

[11] Patent Number: 5,522,284

[45] Date of Patent: Jun. 4, 1996

[54] DEVICE FOR OPENING SCREWED LIDS AND THE LIKE

[75] Inventor: Heli Säde, Helsinki, Finland

[73] Assignee: Fiskars Consumer Ov Ab, Billnas, Finland

[21] Appl. No.: 390,620

[22] Filed: Feb. 16, 1995

[51] Int. Cl.[6] ..... B67B 7/14

[52] U.S. Cl. ..... 81/3.43; 81/64

[58] Field of Search ..... 81/3.4, 3.43, 64, 81/65.2

[56] References Cited

U.S. PATENT DOCUMENTS

| | | | |
|---|---|---|---|
| 2,013,209 | 9/1935 | Hargreaves | 81/64 |
| 2,430,144 | 11/1947 | Shick, Jr. | 81/3.4 |
| 2,474,167 | 6/1949 | Rundell | 81/3.4 |
| 4,150,592 | 4/1979 | Mott | 81/64 |
| 4,543,858 | 10/1985 | Luck | 81/3.43 |
| 4,889,018 | 12/1989 | Shaffer . | |

FOREIGN PATENT DOCUMENTS

3151035A1 7/1983 Germany .

*Primary Examiner*—Bruce M. Kisliuk
*Assistant Examiner*—Joni B. Danganan
*Attorney, Agent, or Firm*—Foley & Lardner

[57] ABSTRACT

The invention relates to a device for opening screwed lids or rotating various objects. The device comprises a handle with two portions, and a loop fastened to one handle portion. The loop is tightened around the edge of the lid by squeezing the handle portions against each other, whereby a cam in the handle portion locks the loop relative to the handle, and a loop and the end of the handle portion close to the lid move closer to each other, which increases the tightening of the loop around the lid.

21 Claims, 2 Drawing Sheets

DEVICE FOR OPENING SCREWED LIDS AND THE LIKE

FIELD OF THE INVENTION

This invention relates to a device for opening screwed lids and the like, comprising a handle having two portions displaceable relative to each other, and a flexible loop means to be positioned around the lid and tightened against it.

BACKGROUND OF THE INVENTION

Opening the screwed lid of different kinds of containers, particularly vacuum containers, such as cans and bottles, often causes problems in homes. To facilitate the opening, various devices have been invented which comprise a loop to be positioned around the lid and a handle attached to the loop for increasing the turning force. One such device is disclosed in U.S. Pat. No. 4,889,018 issued on Dec. 26, 1989 to Shaffer. It comprises a loop attached to a handle at its one end only. To unscrew the lid, the free end of the loop is positioned between the edge of the lid and the end of the handle, whereafter the handle is pressed against the lid so that the free end of the loop will lock in position. This device requires a relatively great handiness from the user, as the free loop end may easily slip away from between the lid edge and the handle end.

Another known solution is disclosed in German Published Patent Application DE 3 151 035 A1, published on Jul. 7, 1983 naming Kopineck et al. as inventors. In this case, the handle is divided longitudinally into two portions slidable relative to each other. The loop ends are fastened to the different handle portions. To open the lid, the loop is positioned around the lid and one of the handle portions is displaced away from the lid until the loop tightens around the lid, and the handle portions are then interlocked by means of a screw. Finally, the handle is turned in the opening direction of the lid. This known lid opener is too complicated to use to become widely used in households. In addition, the mutually movable handle portions make it difficult to grip the handle firmly.

SUMMARY OF THE INVENTION

The present invention facilitates the opening of screwed lids by allowing a flexible loop to be tightened around the lid and locked in the tightened state in an extremely simple way. The device according to the invention is characterized in that the handle portions are interconnected so that they are moveable towards and away from each other, and in that the loop is arranged to pass between the handle portions. The handle portions have locking means cooperating with each other so as to lock the loop means to the handle to facilitate opening the lid.

In the device according to the invention, the loop can be tightened in its final position around the lid and locked in this position by a single movement: by squeezing the handle portions closer to each other. This squeezing movement is so natural that the device should alleviate the problems associated with conventional devices of this type. The device is especially simple to use if one end of the loop means is fastened to one of the handle portions.

If the handle is elongated and the loop means is fastened to one handle end, it is preferable to interconnect the handle portions by means of a hinge positioned at the handle end opposite the end to which the loop means is fastened.

The handle portions can be made moveable relative to each other, as required by the invention, simply by interconnecting the handle portions at the end remote from the loop. This solution is also recommended for the reason that the handle portions can thus easily be arranged to move over the greatest distance relative to each other at the handle end close to the loop. In that case, the loop can be tightened around the lid in an amount greater than the relative movement of the regions of the handles which are actuated by the user. In addition, if the locking surfaces of the handle are positioned close to the hinge end of the handle, the device can in a simple way be made to operate in the right order, that is, the loop is first locked in position and then tightened around the lid.

To ensure that the loop will be locked reliably, it is preferable for the locking means of the handle to be formed by a cam provided in one handle portion and a support surface provided in the opposite handle portion. As the loop surface to be positioned against the lid is often made uneven to achieve good gripping properties, it is preferable to position the cam in the handle portion to which the loop means is connected.

To facilitate positioning the loop around the lid before the loop is actually tightened, it is advisable to provide one of the handle portions with an opening between the locking means and the hinge. The loop means protrudes through this opening from the space between the handle portions.

The device according to the invention can be formed as an integral body if it is made of a suitable material, such as plastic.

BRIEF DESCRIPTION OF THE DRAWINGS

In the following, a preferred embodiment of the device according to the invention will be described in greater detail with reference to the attached drawings, where.

DETAILED DESCRIPTION OF THE PREFERRED EMBODIMENT

Figure 1:
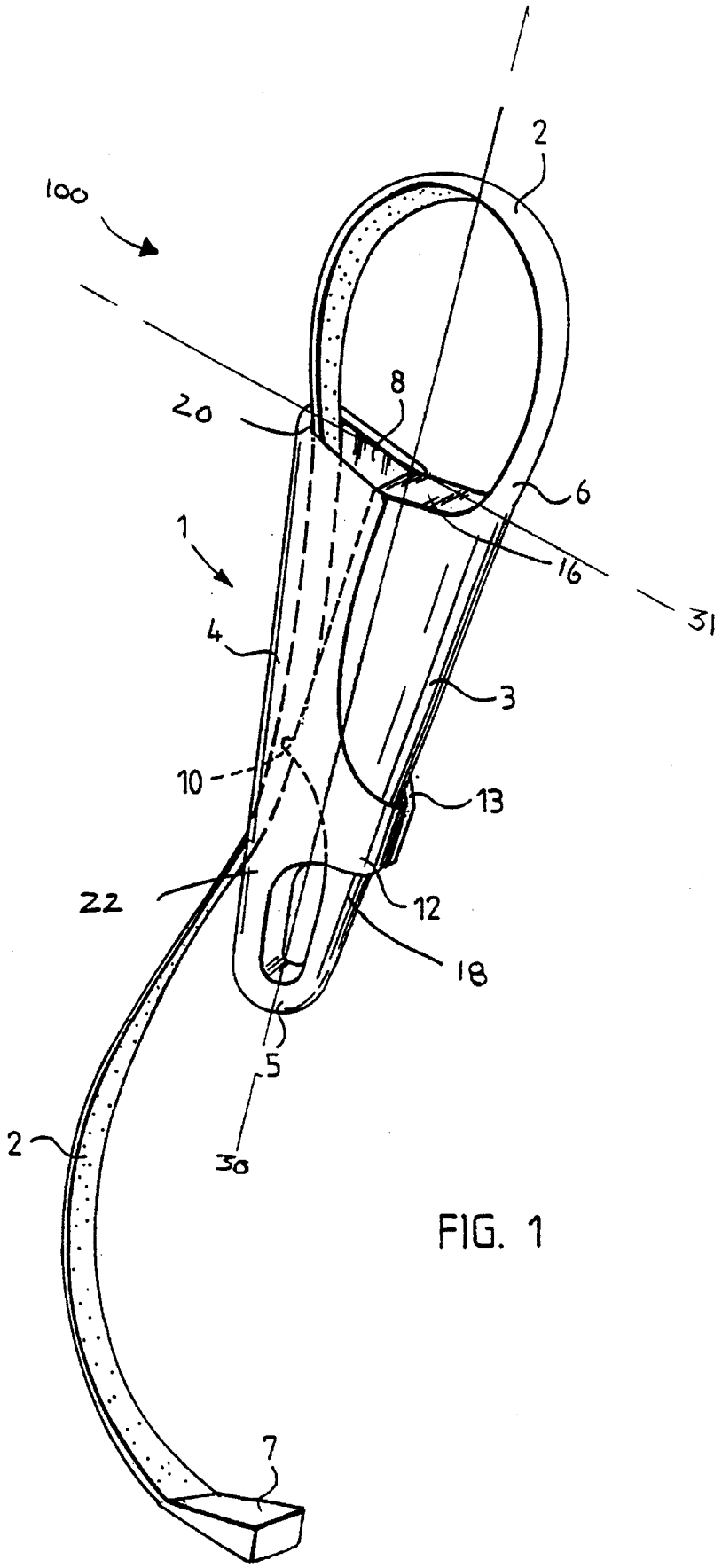
FIG. 1 is a perspective view of a device according to the present invention.

The opening device or hand tool 100 for screwed lids or rotatable object 14 shown in the figures comprises an elongated handle 1 and a flexible loop means 2. Handle 1 has a first handle portion 3 and a second handle portion 4. First handle portion 3 includes a proximal end 16 and a distal end 18 opposite proximal end 16. Second handle portion 4 includes a second proximal end 20 and a second distal end 22 opposite proximal end 20.

First and second handle portions 3, 4 are interconnected at distal end 18 and second distal end 22 by a hinge 5. Loop means 2 includes a loop end 6 attached to first handle portion 3 at proximal end 16. Loop means 2 further includes a free end 7 having a thickening portion. Hinge 5 allows first and second handle portions 3, 4 to be moved toward and away from each other substantially in the direction of the tangent at the points of contact between handle portions 3, 4 and lid 14. Alternatively stated hinge 5 allows first and second handle portions 3, 4 to be moved towards and away from each other substantially perpendicular to a longitudinal axis 30 of handle 1.

Second handle portion 4 is U-shaped in cross-section so that it forms a trough 8 opening towards first handle portion 3. First handle portion 3 in turn has such dimensions that it can be fitted at least partly into trough 8 of second handle portion 4. The outward surface of the second handle portion 4 is provided with an opening 9 close to hinge 5. Opening 9 is in communication with trough 8. As appears from the figures, loop means 2 passes through trough 8 and opening 9 so that its free end 7 is positioned outside handle 1. When the device 100 is in a position for use, loop means 2 is thus positioned partially between first and second handle portions 3, 4.

The first handle portion 3 is provided with a projecting cam 10 in its surface facing the bottom of trough 8. Cam 10 is positioned close to distal end 18 of first handle portion 3 near hinge 5. Trough 8 of second handle portion 4 includes a suspect surface 11 located opposite to cam 10.

Second handle portion 4 is provided with projections 12 and 13 which extend toward and encircles first handle portion 3 forming a stop thereby limiting the movement of handle portions 3 and 4 away from each other.

Figure 2:
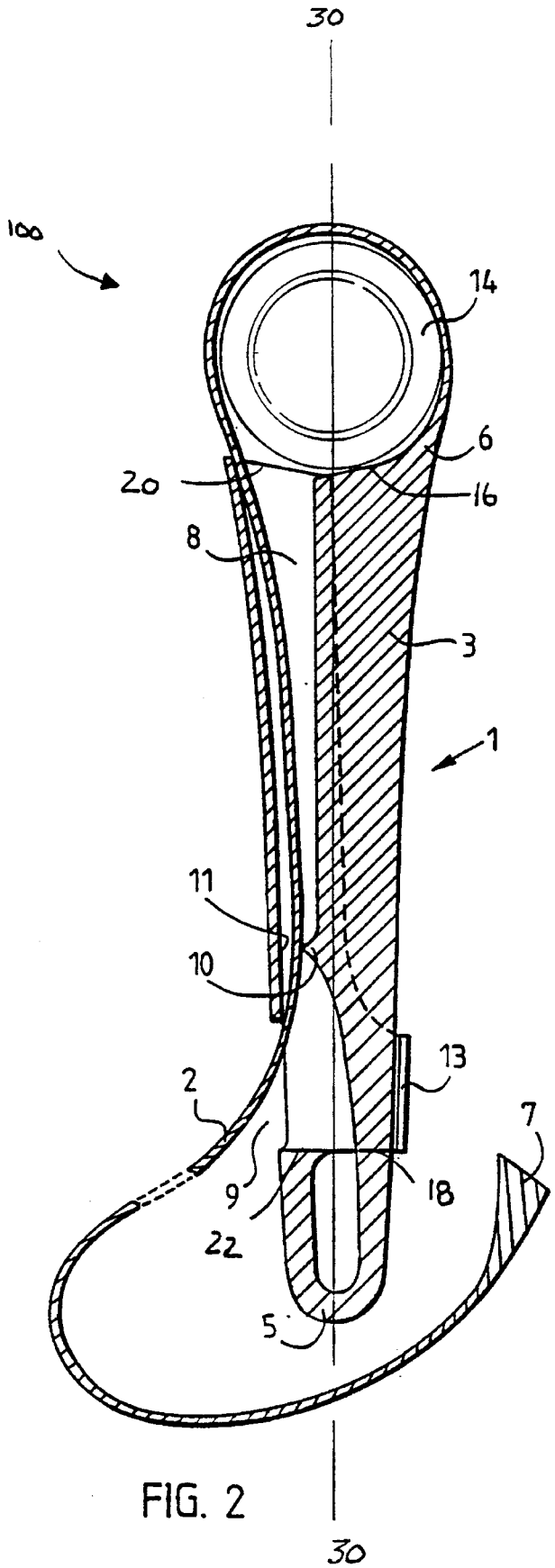
FIGS. 2 and 3 are longitudinal sectional views of the device before and after the loop is tightened around the lid.
Figure 3:
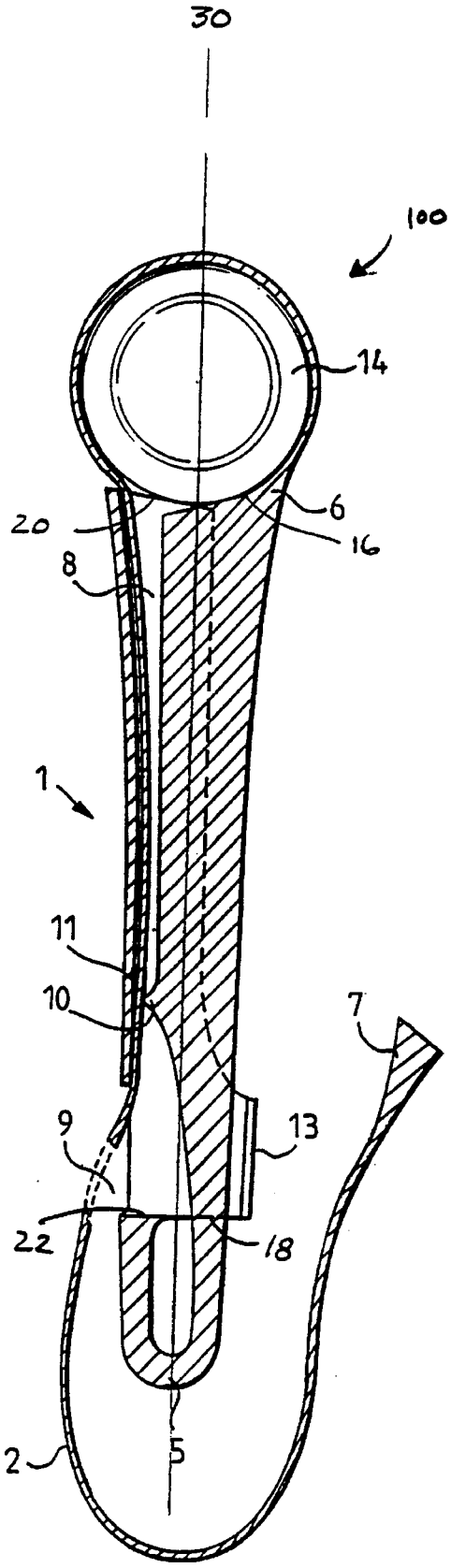

The opening device 100 according to the invention operates in the following way. Loop means 2 is drawn out of handle 1 to such an extent that it reaches loosely around lid 14, see FIG. 2. At this stage, hinge 5 keeps the first and second handle portions 3, 4 as far from each other as allowed by projections 12, 13. When handle 1 is then squeezed by hand against the action of hinge 5, first handle portion 3 enters trough 8 of second handle portion 4. As a result of the movement of first and second handle portions 3, 4 towards each other, cam 10 presses loop means 2 against support surface 11 of second handle portion 4, thus locking loop means 2 so that it is not able to move in its longitudinal direction relative to handle 1 i.e., substantially along axis 91. As a result of the same movement, proximal end 16 of first handle portion 3 and second proximal end 20 of second handle portion 4 move closer to each other substantially in the direction perpendicular to longitudinal axis 30 of handle 1, which causes loop means 2 to be tightened around lid 14. Handle 1 is squeezed until loop means 2 has tightened appropriately around lid 14, see FIG. 3, whereafter handle 1 is turned in the opening direction of lid 14 to open lid 14.

The device 100 according to the invention is not limited to the above embodiment, but it may vary within the scope of the attached claims. For example, the shape of first and second handle portions 3, 4 may be quite different from that shown in the figures, and hinge 5 may be replaced e.g. by flexible fastening means positioned substantially centrally in the handle portions. The joint between the handle portions may also be such that one handle portion remains immovable relative to the lid 14 and only the other portion moves perpendicularly or obliquely towards the first-mentioned portion when the loop is tightened. Cam 10 and the support surface 11 can also be replaced with other arrangements, and cam 10 and support surface 11 may be formed in regions of the handles other than those illustrated in the Figures. Parts 2, 3 and 4 may form an integral body or be separate bodies fastened to each other. Loop means 2 may also be fully separate from handle 1, in which case its both ends pass between the first and second handle portions 3, 4.

The device 100 according to the invention can, of course, also be used for other purposes than opening screwed lids 14, such as closing screwed lids 14, and generally loosening or fastening any screwed objects or rotating entire assemblies.

I claim:

1. Device for opening screwed lids, comprising:

a handle having a first handle portion and a second handle portion;

a loop means to be positioned around a lid and connected to the handle, said loop being provided to pass between said handle portions;

said first and second handle portions being interconnected such that they are moveable towards and away from each other substantially perpendicular to a longitudinal axis of the handle; and means for locking and tightening said loop about the lid by movement of said first and second handle portions toward each other.

2. Device according to claim 1, wherein said loop means is fastened at its one end to one handle portion.

3. Device according to claim 2, wherein said handle is elongated and said loop means is fastened to one end of the handle, said handle portions being interconnected by means of a hinge positioned at the handle end opposite to said end to which said loop means is fastened.

4. Device according to claim 3, wherein said hinge is integral with said handle portions.

5. Device according to claim 3, wherein said locking means is positioned proximate to said hinge.

6. Device according to claim 3, wherein one of the handle portions has an opening between said locking means and said hinge, said loop means projecting from a space between said handle portions through said opening.

7. Device according to claim 1, wherein said locking means is formed by a cam positioned in one handle portion and a support surface positioned in the opposite portion.

8. Device according to claim 7, wherein said cam is positioned in the handle portion to which said loop means is fastened.

9. Device according the claim 1, wherein said loop means is integral with said handle.

10. Device for opening lids comprising:

an elongated handle having a first handle portion and a second handle portion, the first handle portion having a first distal end and a first proximal end, the second handle portion having a second distal end and a second proximal end, the first and second handle portions hingedly connected at the first and second distal ends;

a loop having a loop end and a free end, said loop end attached to said first proximal end, said loop having a portion between said free end and said second proximal end received between said handle portions; and a cooperable locking means disposed in a region of said handle proximate said distal ends and distal said proximate ends, the locking means engagable with said loop in a region of said portion, wherein said cooperable locking means includes a first member connected to said first handle portion cooperating with a second member connected to said second handle portion.

11. Device according to claim 10, wherein the hinge is integrally formed with the first and second handle portions.

12. Device according to claim 10, wherein the loop is integrally formed and extending from the first proximal end.

13. Device according to claim 10, wherein the first member is a cam and the second member is a support surface, the cam cooperating with the support surface thereby preventing movement of the loop with respect to the handle when the first and second handle portions are moved toward one another.

14. Device according to claim 10, wherein the second handle portion includes a stop extending toward and around the first handle portion limiting the distance in which the first and second handle portions may move away from each other.

15. Device according to claim 10, wherein the first and second handle portions are displaceable relative to each other substantially perpendicular to a longitudinal axis of a handles.

16. A hand tool removably securable to a rotatable object comprising:

a first handle portion having a proximal end and an opposed distal end;

a second handle portion having a proximal end and an opposed distal end, said handle portions being movably connected at the distal ends;

a flexible loop having a loop end and a distal free end, the loop end being connected to the first handle portion at the proximal end thereof;

a locking means connected to the handle portions for locking said loop with respect to the handle portions; and an opening formed in one of the handle portions intermediate the distal ends and the locking means, the free end projecting from the tool through the opening.

17. The hand tool according to claim 16, wherein the handle portions are hingedly connected.

18. The hand tool according to claim 16, wherein the loop is integrally formed and extends from one of the handle portions.

19. The hand tool according to claim 16, wherein the locking means includes a cam attached to one of the handle portions, and a support surface cooperable with the cam and attached to the other of the handle portions.

20. The hand tool according to claim 16, wherein one of the handle portions nests within the other of the handle portions when the handle portions are moved towards each other, the other of the handle portions including an integrally formed stop extending toward and around the one of the handle portions limiting the opening of the handle portions relative to each other.

21. Device for opening screwed lids, comprising:

a handle having two portions displaceable relative to each other; and a flexible loop means to be positioned around a lid and tightened against it;

said handle portions being interconnected so that they are moveable towards and away from each other substantially perpendicular to a longitudinal axis of the handle for tightening and loosening, respectively, of said loop around the lid;

said loop means being arranged to pass between said handle portions, said handle portions having cooperable locking means to lock said loop means to said handle when opening said lid, wherein said loop means is fastened at its one end to one handle portion;

said handle is elongated and said loop means is fastened to one end of the handle, said handle portions being interconnected by a hinge positioned at the handle end opposite to said end to which said loop means is fastened; and wherein one of the handle portions has an opening between said locking means and said hinge, said loop means projecting from a space between said handle portions through said opening.

* * * * *

UNITED STATES PATENT AND TRADEMARK OFFICE

CERTIFICATE OF CORRECTION

PATENT NO. : 5,522,284

DATED : June 4, 1996

INVENTOR(S) : Heli Sade

It is certified that error appears in the above-indentified patent and that said Letters Patent is hereby corrected as shown below:

In column 3, line 17, change "suspect" to --support--.
In column 3, line 34, change "91" to --31--.

Signed and Sealed this

Twenty-second Day of October, 1996

*Attest:*

Bruce Lehman

BRUCE LEHMAN

*Attesting Officer*

*Commissioner of Patents and Trademarks*